United States Patent [19]

Rath

[11] Patent Number: 4,756,228

[45] Date of Patent: Jul. 12, 1988

[54] REPEATING WEAPON ACTUATING SPRING AND GUIDE

[75] Inventor: Hans M. Rath, Staunton, Va.

[73] Assignee: Ameram Corporation, Santa Barbara, Calif.

[21] Appl. No.: 877,874

[22] Filed: Jun. 24, 1986

[51] Int. Cl.[4] ..... F41D 5/04

[52] U.S. Cl. ..... 89/191.01; 89/199; 42/75.01

[58] Field of Search ..... 89/184, 190, 191.01, 89/199

[56] References Cited

U.S. PATENT DOCUMENTS 2,468,784 5/1949 Seagraves ..... 89/191.01

4,569,270 2/1986 Timari ..... 89/184

*Primary Examiner*—Stephen C. Bentley

*Attorney, Agent, or Firm*—Donald D. Mon

[57] ABSTRACT

A repeating weapon in which its bolt carrier is slotted to enable an actuating spring to move laterally, carrying with it a gas piston. The spring is anchored to the receiver in such a way as to be anchored or released by axial movement. This enables a quick and simple field stripping sequence.

9 Claims, 3 Drawing Sheets

REPEATING WEAPON ACTUATING SPRING AND GUIDE

FIELD OF THE INVENTION

This invention relates to automatic and semi-automatic cartridge-firing weapons and especially to such a weapon which is adapted for ready field stripping.

BACKGROUND OF THE INVENTION

The art of the automatic and semi-automatic weapons is well advanced. Over many years of painstaking improvements, the firing rate has been significantly increased, and the weight of the weapon significantly decreased. The operational reliability has also improved substantially.

Still, whatever standards of performance are obtained, the weapon must frequently be stripped for field maintenance and also be dismantled for routine care. Routine care conducted in the barracks rarely involves tactical problems. The soldier, however skilled or unskilled, must and does simply plod his way through the procedures, and if there is no hostile presence for which he would need the weapon, complexity of construction or time consuming stripping procedures may be a nuisance, but they are not a safety concern.

The same cannot be said for field stripping operations, where the disability of the weapon for any period of time is not only undesirable, but can be life threatening. Then in the event of malfunction, the capacity to strip, clean and reassemble the weapon in the shortest time becomes a critical consideration. The capacity to conduct this operation in the shortest time requires that the construction of the weapon be elegantly simple, and that the required procedure be simple enough for the most basic soldier to carry out without supervision, delay, or uncertainty.

Thus, a weapon to be optimal under these circumstances should have a minimum of parts to be kept in mind by the soldier, be disassembled with least motion and preferably without special tools, and be reassembled using literally abrupt movements without endangering surfaces which should not be scratched or galled. These are not new considerations. All competent weapon designers must have them in mind. However, existing automatic and semi-automatic weapons continue to suffer from complexities that reduce the weapon to a less than optimum device.

A weapon according to this invention can be dissassembled in about nine seconds, total. No special tool is needed. No part need be laid aside to be required during the procedure, thereby greatly improving the integrity of the weapon from a readiness standpoint. The parts of the weapon whose condition is likeliest to require field stripping are not only readily accessible, but also can conveniently be removed and replaced, although this latter feature is an unlikely requirement in the field. It is much likelier that the disassembled weapon will merely be immersed and rinsed in water to remove sand or dirt, and the weapon quickly reassembled, with or without applying oil or lubricant.

While this invention is applicable to many specific types of weapons, its principal use is expected to be in assault rifles, where simplicity, lightness of weight, and ready stripping and reassembly are prime requirements.

BRIEF DESCRIPTION OF THE INVENTION

A weapon according to this invention includes a receiver which mounts a typical grip and trigger group, a magazine, and such other parts as a bolt, a firing pin, an extractor, and an ejector pin. A barrel is mounted to the receiver, and its chamber receives cartridges to be fired.

A gas cylinder is mounted to the barrel by a gas cylinder housing, and a gas port extends from the barrel to the gas cylinder to provide gas pressure to actuate the weapon during automatic or semi-automatic operation. A front sight is mounted to the gas cylinder housing, so that the relationship between the barrel and the front sight is not affected by the field stripping operation.

The receiver has tracks to support and guide a bolt carrier. A bolt is detachably attached to the carrier for reciprocating movement toward and away from the chamber. The bolt carrier mounts a gas piston which makes a sliding fit in the gas cylinder. The piston and bolt carrier move as a unit.

A recoil action spring is interposed between the receiver and the gas piston, but in a unique way which constitutes a feature of this invention. The action spring is fixed to the gas piston at one of its ends, and to a spring anchor at its other end. The anchor is adapted detachably to engage the receiver so it can be released by a quick longitudinal movement.

The bolt carrier is configured to allow the spring to bend in order to facilitate removal of the gas piston, action spring and bolt carrier.

According to a preferred feature of this invention, a heat shield is mounted to the anchor and is engageable in a recess in the receiver to form a removable portion of the receiver in use, and the anchor is attached to the shield.

The above and other features of this invention will be fully understood from the following detailed description and the accompanying drawings, in which:

DETAILED DESCRIPTION OF THE INVENTION

Figure 1:
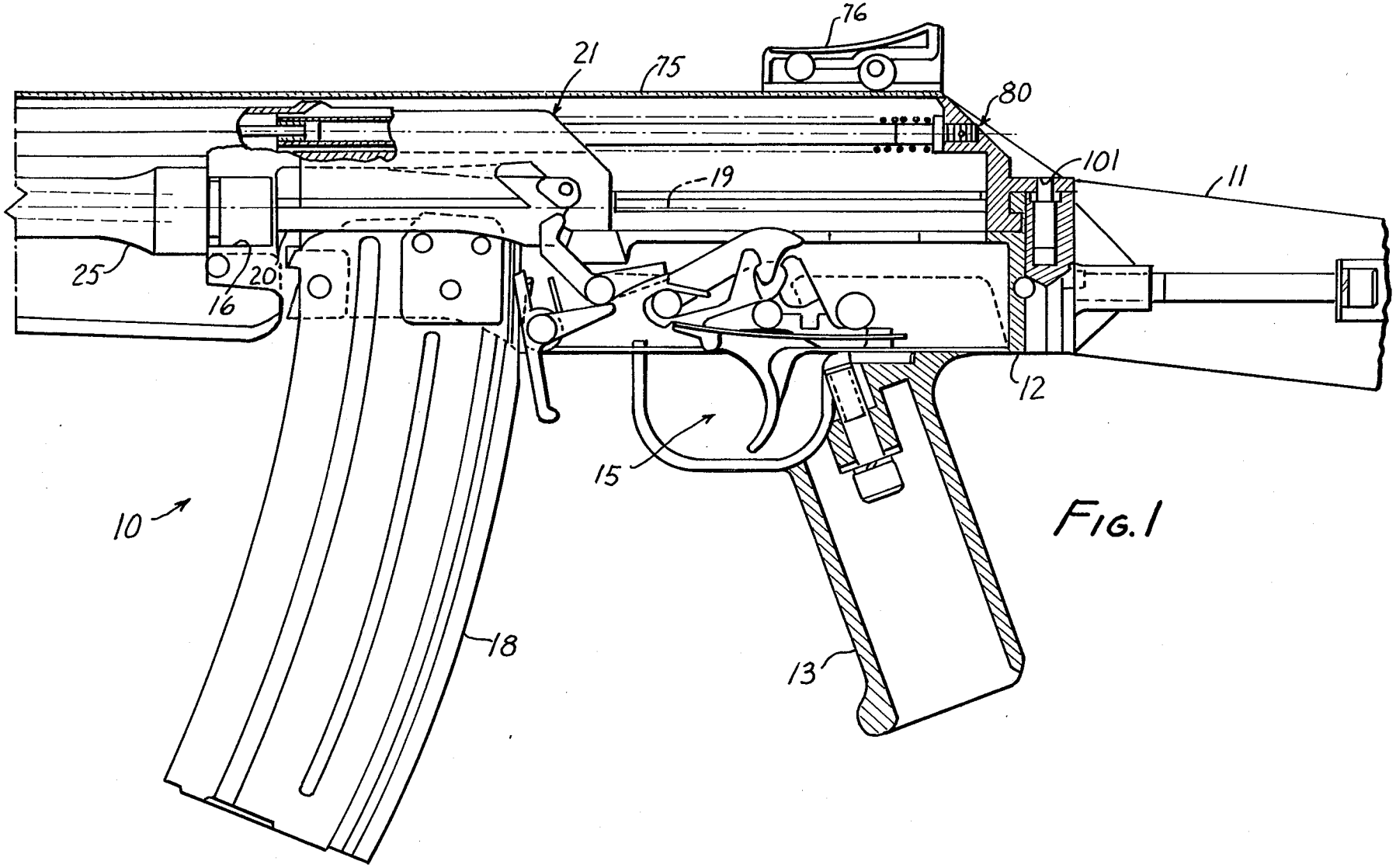
FIG. 1 is a side elevation, partly in cutaway cross section, of one part of the length of a weapon according to the invention.

FIG. 1 shows the butt end of a weapon 10 according to the invention. An optical shoulder rest 11 is shown detachably attached to receiver 12. A pistol grip 13 is also mounted to the receiver. A trigger group 15, which is entirely conventional, is also mounted to the receiver. A magazine 18 is detachably attached to the receiver. Groove 19 in the receiver act as tracks for a bolt 20 and bolt carrier 21. The bolt and trigger group include such conventional features as an extractor and a firing pin, which form no part of the invention, and therefore will not be described in detail.

A suitably rifled barrel 25 is threaded to the receiver, in alignment with a chamber (not shown) in the end of the barrel. The receiver rises past the barrel to form a cylinder aperture 26, and a socket 27 (FIG. 2).

The forward end of the barrel can be provided with a flash suppressor, or with means for projecting a grenade, as desired.

Figure 2:
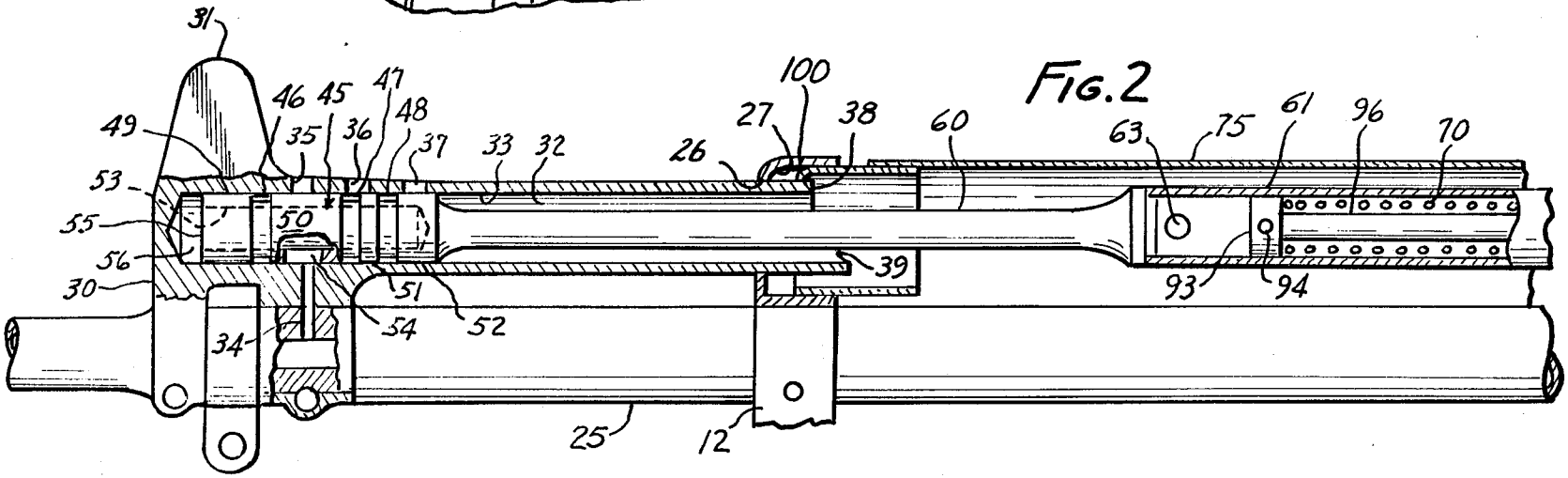
FIG. 2 is a continuation of FIG. 1.

In FIG. 2, a cylinder mount 30 is pinned to the barrel by suitable fastener means. It carries a forward sight 31 which is kept in permanent alignment with the barrel because of this mounting arrangement. A gas cylinder 32 is formed in the cylinder mount, extending parallel to and spaced from the barrel. Is has a circularly cylindrical bore 33. A gas inlet port 34 side-taps the barrel, and enters the gas cylinder near its forward end through an elongated slot 54 in the side of the gas piston 45. A plurality of gas exhaust ports 35, 36, 37, side-tap the gas cylinder and vent it to atmosphere at appropriate times in the firing sequence. The gas cylinder is closed at its forward end, and is open at its rearwardly facing end 38. At this rearwardly facing end, inside the receptacle, the end is mitered at 39 to assist in re-assembly, as later will be disclosed.

A cylindrical gas piston 45 makes a sliding, fluid sealing fit in the gas cylinder. Because seals such as O-rings and split rings are undesirable in applications such as this, three labyrinth grooves 46, 47, 48 are provided, which with their adjacent lands 49, 50, 51 and 52 will provide adequate fluid retention. A central bore 53 extends from the front end of the piston past an inlet slot 54. The inlet slot will be aligned with the inlet port 34 during the initial movement of the piston, after which land 49 will cut off such inlet pressure as might happen to exist at that moment.

The front end 55 of the piston ultimately will pass the exhaust ports in sequence, and will then exhaust the pressure from gas compartment 56. The sizes and locations of the inlet port and exhaust ports will be established to provide a firing rate between about 550 and 600 rounds per minute.

Figure 3:
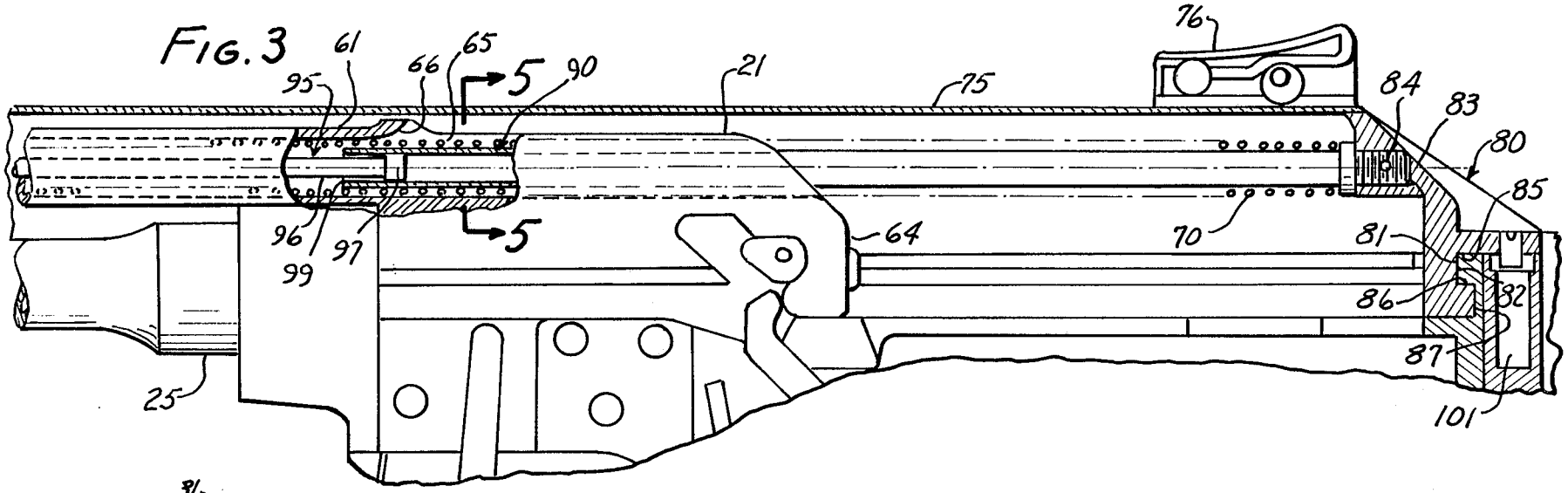
FIG. 3 is a more detailed showing of a portion of FIG. 1.

Piston 45 includes as an extension a piston rod 60 of reduced diameter. It projects from the gas cylinder, and is rigidly attached to a forward extension 61 of bolt carrier 21, shown in FIG. 3. Extension 61 (FIG. 2) is rigidly connected to rod 60 by a pin 63. Extension 61 (FIG. 3) is a hollow tube at its forward end, and extends rearwardly toward a downwardly depending flange 64. At its rear end, and extending forward for part of the length, a slot 65 is formed in the top of the bolt carrier 21. An upwardly extending guide flange 66 is formed at the forward end of the slot.

The purpose of slot 65 is to enable and facilitate the removal and re-assembly of the gas piston, the bolt carrier, and an actuating spring 70 that will now be described. The purpose of actuating spring 70 (FIG. 3) is to force the bolt carrier and bolt forwardly so as to press a cartridge into the chamber. In so doing, it also moves the gas piston forwardly. When the weapon is fired and the bullet passes through the barrel, for an instant the high gas pressure behind the bullet pressurizes the gas chamber. This forces the gas piston rearwardly, and the bolt carrier is moved by it, because they are structurally continuous. After the bullet leaves the barrel the inlet port pressure is relieved, and also the exhaust ports have opened the chamber to atmosphere. Then the spring moves the assembly of the gas piston and the bolt carrier forwardly. As a consequence, the fired case will have been ejected, and a new cartridge will have been placed in the reciever chamber. Depending on the setting of the trigger assembly, the sequence may be repeated automatically, or may instead require another pull on the trigger.

In order properly to strip this weapon, the bolt carrier and the gas piston must be removed. In the preferred embodiment the bolt itself will also be removed. The removal of these parts for field servicing in known weapons is unduly time comsuming. It is an object of this invention to reduce the time by improving the design.

A heat shield 75 is necessary to protect the user from the parts of the weapon which become heated with repeated firing. It is also used as part of the base support for the spring, as well as for means by which the weapon is manipulated during the stripping operation. Because it is definitively anchored, the rear sight 76 is mounted to it. Then when all parts are in place, the front and rear sight are accurately aligned relative to the barrel.

A spring anchor 80 (FIG. 3) comprises a prong 81 and matching receptacle 82. One of these is on the frame, and the other is on a fitting 83. In the illustrated embodiment, prong 81 is on the frame. It is a rectangular structure which fits with matching receptacle 82. The receptacle has walls 85, 86 that embrace it and when engaged with the prong to prevent upward and downward relative movement. However, walls 85 and 86 are axially aligned, so that the fitting can be moved forwardly, enabling shoulder 87 to pass prong 81, as will be described.

A rigid or stiffly flexible spring guide tube 98 is pinned to the fitting 83 with pin 84. The action spring is fixed or against a shoulder of the guide tube near its rear end. The spring extends forwardly into the bolt carrier extension 61 and is contained by retainer 61 and pin 63 at the forward end of stem 96. The spring and its guide are disposed directly beneath the slot in the bolt carrier.

The purpose of the guide, and of the cylindrical bore in the forward extension of the bolt carrier, is to keep the spring aligned so it will properly exert an axial force. However, when the weapon is to be stripped there must be a bending movement in the assembly of the heat shield and spring system, because neither the gas cylinder nor the gas piston will pivot or tilt to enable this movement. A guide rod assembly 95 rearwardly located in extension 61 has a reduced diameter rod stem 96, and a head 97. Guide tube 98 receives the head and part of the stem in trombone relationship. The end 99 of guide tube 90 is crimped inwardly so as to retain the head. This enables the rod stem and the tube to slide relative to one another when the piston moves rearwardly. The head is relatively short, and has a sufficient clearance around it to permit the bending movement shown in FIG. 4 when the spring is extended. However, the rod stem and the guide tube stay sensibly aligned during use, whereby the inside wall of extension 61 and the outside wall of the guide tube keep the spring suitably aligned so that it will exert its usual force. There will of course be some spring deforming undulations during compression, but they are controlled and insignificant.

Fitting 83 is rigidly attached to the heat shield, and the guide tube is rigidly attached to the fitting. Notice in FIG. 3 that when the fitting is firmly in place, the forward edge 100 of the heat shield (FIG. 2) is in socket 27, and there is sufficient depth of socket that this forward edge can go into the socket far enough for the prong 81 and shoulder 87 to clear each other when the heat shield is moved forwardly and lifted.

The example of a trombone type joint shown is merely exemplary. Any reasonably stiff elongated and contractible structure which will permit only limited bending is suitable. For example, groups of parallel wires, formed into a bundle, with some attached to the retainer 93, and alternate wires attached to the rear end of guide tube 90, will also serve.

If desired, the fitting can be held in place by a releasable retainer 101. Preferably it is a spring loaded device, adapted to be pressed down with the nose of a bullet. This is optional.

The operation of the trigger group, the bolt and the bolt carrier during firing are conventional and will not be described in detail. When the bullet leaves the barrel, a sharp burst of gas pressure will be exerted in the gas chamber through the inlet port. Movement of the piston the entire length of the gas cylinder 32, with which the bolt carrier is integral, moves the bolt carrier rearwardly, compressing the action spring and ejecting the empty shell casing. When the gas pressure is relieved through the exhaust ports, the piston and bolt carrier will continue rearward until the spring absorbs all the kinetic energy exerted by the gas pressure, and the spring returns the bolt carrier forwardly to arm the weapon picking up a new shell on the way forward. The weapon will now have gone through a cycle.

Figure 4:
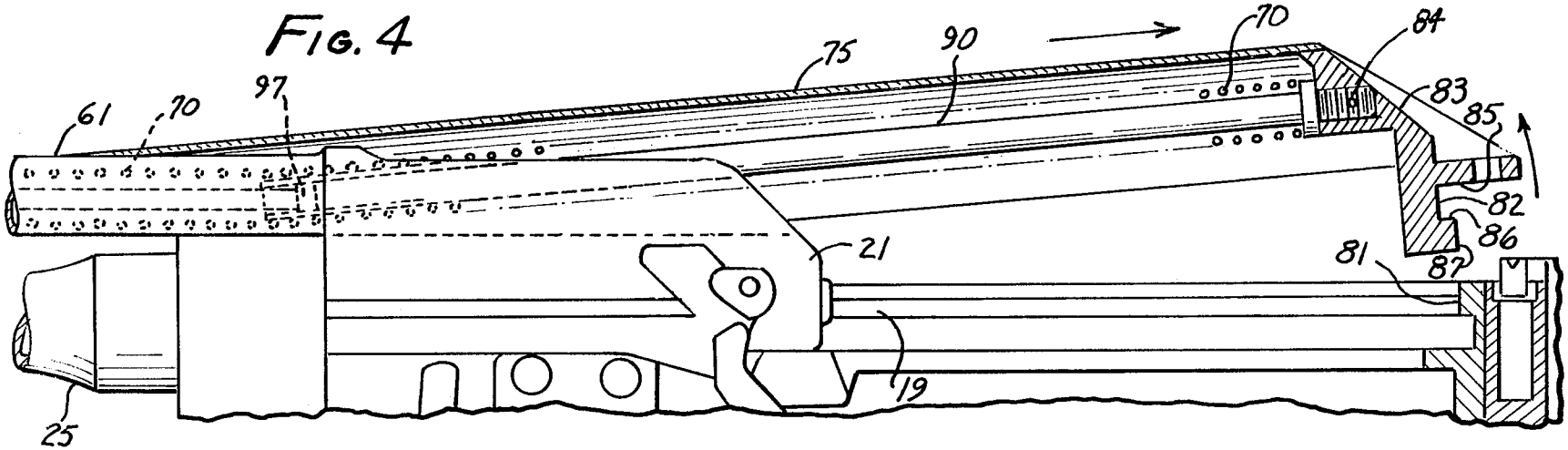
FIG. 4 is a fragmentary view of a portion of FIG. 3 in a different condition.
Figure 5:
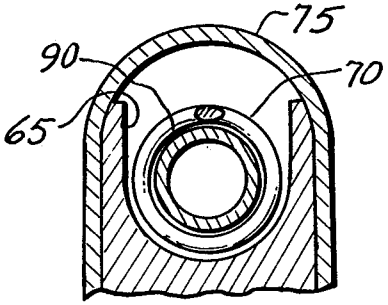
FIG. 5 is a cross section taken at line 5—5 in FIG. 3.

To strip the weapon, one need merely release latch 101, grasp the heat shield, and move it forwardly so the shoulder ledge 87 will clear the frame prong 81, and lift as shown in FIG. 4. Relaxing the forward pressure just applied will allow the heat shield and fitting 83 to pass rearwardly over the frame until the spring guides 95 and 90 fully extend (head 97 contacts crimped surface 99). Further rearward motion of the heat shield will extract the forward end of spring 70 from the bolt carrier extension 61 bore until the end of the spring can clear lip 66 and be lifted upward through slot 65 away from the weapon. The bolt carrier, bolt and piston are then slid rearwardly along grooves 19 (FIG. 1) until the bolt carrier can be lifted through openings in grooves 19. The piston will have moved to the lip 39 (FIG. 2) and will lift upward freely. The bolt may or may not be separated from the bolt carrier at this time, this being unimportant to the invention.

To reassemble the weapon, the bolt carrier (with bolt) and the piston are pressed toward the gas cylinder as the bolt carrier re-engages the openings in grooves 19. The mitered end 39 provides improved convenience of entry by supporting the bottom lip of the piston head. The piston and bolt carrier are moved forward until the bolt is in the locked position.

Next, the heat shield, and action spring assembly are positioned so the forward end of the spring can be inserted into slot 65, moved further forward until the spring is fully engaged in bolt carrier extension 61, at which time the forward lip 100 of the heat shield 75 is engaged with socket 27 as final pressure is applied to compress the spring assembly slightly and move lip 100 to the bottom of socket 27 allowing ledge 87 to pass downwardly past prong 81 for locking of the axially-engagably surfaces 85 and 86. Then the finally applied pressure is released.

This construction enables a swift disassembly and reasembly of the weapon. It requires no special tool (only sometimes requiring the point of a bullet), and no parts become loose so as potentially to be lost.

This invention is not to be limited to the embodiments shown in the drawings and described in the description, which are given by way of example and not of limitation, but only in accordance with the scope of the appended claims.

I claim:

1. In a repeating weapon of the class having a frame, a receiver, a barrel, a bolt, a bolt carrier, a gas cylinder ported to the barrel, a as piston connected to said bolt carrier slidably fitted into said gas cylinder to be shifted in one direction by fluid pressure in the cylinder, and an actuating spring opposed between said frame and said piston to shift said piston in its other direction, the improvement comprising:

said spring being a coil spring a spring guide in lateral-restraining relationship with said spring, said spring guide enabling the distance between the gas piston and the frame to vary, one end of said spring being attached to the piston, and the other end being releasably anchored to the frame and being bendable to permit the end of the spring that is opposed to said frame to be raised without raising the bolt carrier, said bolt carrier centering the spring, and having a slot therethrough to pass the spring laterally.

2. Apparatus according to claim 1 in which said spring guide includes a plurality of relatively slidable elongated elements, at least one being associated with said piston and

3. Apparatus according to claim 1 in which said spring guide includes a guide rod and a guide tube, said guide rod entering said guide tube and being movable therein in a trombone-type sliding relationship.

4. Apparatus according to claim 3 in which said piston has a cylindrical extension and in which said guide rod extends in and from said extension into said guide tube, and in which said spring embraces said guide tube and fits between said guide rod and said extension.

5. Apparatus according to claim 4 in which a head is formed on said guide rod, that is retained in said guide tube, but enables the said bending of the spring guide.

6. Apparatus according to claim 1 in which interengaging spring anchor means on said frame and on said spring releasably anchor said anchored end of said spring to said frame aganist lateral movement unless the spring is axially compressed to release said anchor means from one another.

7. Apparatus according to claim 6 in which said anchor means comprises axially-engageable surfaces attached to said spring and moved toward one another by the spring, in which part of said anchor means can be separated by axial movement of a portion thereof.

8. Apparatus according to claim 7 in which a heat shield means is attached to said anchor means, which shield means are axially movable to move said part of said anchor means axially, thereby to release the anchored end of the spring from the receiver.

9. Apparatus according to claim 8 in which said receiver has a socket adjacent to said gas cylinder, into which the forward end of said heat shield is insertable, there to be retained by force exerted by said spring.

* * * * *